US007377083B2

(12) United States Patent
McCafferty et al.

(10) Patent No.: US 7,377,083 B2
(45) Date of Patent: May 27, 2008

(54) CLIP CONNECTOR AND METHOD

(75) Inventors: Jack McCafferty, San Ramon, CA (US); Rod Dotson, Pleasant Hill, CA (US)

(73) Assignee: Con-Tie, Inc., Danville, CA (US)

( * ) Notice: Subject to any disclaimer, the term of this patent is extended or adjusted under 35 U.S.C. 154(b) by 864 days.

(21) Appl. No.: 10/940,516

(22) Filed: Sep. 14, 2004

(65) Prior Publication Data

US 2006/0059842 A1 Mar. 23, 2006

(51) Int. Cl.
*E04C 5/16* (2006.01)

(52) U.S. Cl. ..... 52/719; 52/677; 52/712

(58) Field of Classification Search ..... 52/649.8, 52/677, 686, 665, 712, 719, 685, 699; 24/339, 24/131 R, 129 C, 546; 403/392, 396, 397, 403/398, 400, 346
See application file for complete search history.

(56) References Cited

U.S. PATENT DOCUMENTS

| | | | | | |
|---|---|---|---|---|---|
| 1,025,330 | A | * | 5/1912 | Straus | 52/685 |
| 1,263,887 | A | * | 4/1918 | Hamilton | 52/719 |
| 1,498,595 | A | * | 6/1924 | Wedmore | 52/719 |
| 1,543,207 | A | * | 6/1925 | Erb et al. | 52/719 |
| 1,684,051 | A | | 9/1928 | Anderson | |
| 1,816,833 | A | * | 8/1931 | Ehlers | 52/719 |
| 1,999,508 | A | * | 4/1935 | Mathews | 52/719 |
| 3,359,019 | A | * | 12/1967 | Pinkney | 403/397 |
| 3,440,792 | A | * | 4/1969 | Schmidgall | 52/687 |
| 3,722,164 | A | * | 3/1973 | Schmidgall | 52/684 |
| D228,119 | S | | 8/1973 | Cox | |
| 3,922,103 | A | * | 11/1975 | Hirato | 403/397 |
| 3,932,049 | A | * | 1/1976 | Hirato | 403/397 |
| 4,152,256 | A | * | 5/1979 | Wennberg | 209/395 |
| 4,452,026 | A | * | 6/1984 | Tolliver | 52/684 |
| 4,610,122 | A | | 9/1986 | De Clercq | |
| 4,641,991 | A | * | 2/1987 | Yaoita | 403/397 |
| 4,920,724 | A | * | 5/1990 | Leach et al. | 52/685 |
| 4,939,883 | A | * | 7/1990 | Swenson | 52/686 |
| 4,989,388 | A | | 2/1991 | Schmidgall et al. | |
| 4,999,965 | A | * | 3/1991 | Schmidgall et al. | 52/684 |
| 5,042,218 | A | * | 8/1991 | Nasca et al. | 52/677 |
| D330,846 | S | * | 11/1992 | Woolledge et al. | D8/354 |
| 5,181,363 | A | * | 1/1993 | Leach et al. | 52/685 |
| 5,371,991 | A | | 12/1994 | Bechtel et al. | |
| 5,542,228 | A | * | 8/1996 | Hagens | 52/712 |
| 5,832,690 | A | * | 11/1998 | Kaines | 52/677 |
| 5,881,460 | A | | 3/1999 | Nowell, III et al. | |
| 5,896,722 | A | * | 4/1999 | Swenson | 52/712 |

(Continued)

FOREIGN PATENT DOCUMENTS

| | | |
|---|---|---|
| DE | 2126981 | 5/1973 |

*Primary Examiner*—Jerry Redman
*Assistant Examiner*—Dinesh Vesra
(74) *Attorney, Agent, or Firm*—Charles L. Thoeming

(57) ABSTRACT

A structural clip includes two connecting legs extending from a resilient spring means with a securing loop at the end of each leg. The angles defined by the legs and by each leg and the spring means when the securing loops are connected to a bottom support member secure that member and a contacting top support member in any spatial relationship one to the other without auxiliary tools. An embodiment useful over a range of support member diameters for perpendicular or parallel reinforcement member alignment, and a method for using the clip also are disclosed.

17 Claims, 3 Drawing Sheets

U.S. PATENT DOCUMENTS 5,913,341 A * 6/1999 Jones ..... 140/119
6,128,882 A * 10/2000 Jones ..... 52/665
6,640,399 B2 11/2003 Perez Romo
6,655,105 B2 * 12/2003 Swenson ..... 52/677

* cited by examiner

CLIP CONNECTOR AND METHOD

CROSS-REFERENCES TO RELATED APPLICATIONS

None.

STATEMENT REGARDING FEDERALLY SPONSORED RESEARCH OR DEVELOPMENT

None.

REFERENCE TO A MICRO-FICHE APPENDIX

None.

BACKGROUND OF THE INVENTION

1. Field of the Invention

The present invention relates generally to fastener apparatus, in particular, to apparatus and a method for fastening concrete reinforcement steel members together during concrete construction.

2. Description of the Related Art

A search of the prior art located the following United States patents which are believed to be representative of the present state of the prior art: U.S. Pat. No. 6,640,399 B2, issued Nov. 4, 2003, U.S. Pat. No. 5,881,460, issued Mar. 16, 1999, U.S. Pat. No. 5,371,991, issued Dec. 13, 1994, U.S. Pat. No. 5,181,363, issued Jan. 26, 1993, U.S. Pat. No. 4,989,3888, issued Feb. 5, 1991, U.S. Pat. No. 4,610,122 issued Sep. 9, 1986, U.S. Pat. No. Des. 228,119, issued Aug. 14, 1973, German Patent No. 2,126,981, issued May 10, 1973; U.S. Pat. No. 1,684,051, issued Sep. 11, 1928, U.S. Pat. No. 1,498,595, issued Jun. 24, 1924; and U.S. Pat. No. 1,025,330, issued May 7, 1912.

BRIEF SUMMARY OF THE INVENTION

Concrete reinforcement steel members are commonly used to strengthen concrete structures in a known manner. These reinforcement members can be in the form of wire mesh sheets or reinforcement steel ("Rebar") positioned in a grid pattern. Many fasteners in the art for these mesh sheets or Rebar require auxiliary tools to secure the fasteners into the desired placement on the mesh or Rebar to join like members. Other fasteners in the art work only for joining members in limited geometric or spatial orientation, one to the other, such as at right angles. Many mesh sheet comprise Rebar of different size diameters, often ranging from ⅜ inch to ⅝ inch.

The present invention provides an improved apparatus and method of use of the apparatus for securing reinforcing bars or mesh grids in position in molds for concrete so as to prevent displacement of the bars or grids while the concrete is being poured or otherwise manipulated prior to setting or hardening of the concrete. The present invention further provides apparatus and a method of using the same without the necessity of auxiliary tools to secure the fasteners into the desired placement on the mesh or Rebar to join like members, such as ½ inch to ⅜ inch or ⅜ inch to ⅝ inch. The apparatus and methods of the present invention can join the mesh or Rebar members in any angular relation, one to the other, and is particularly useful for members perpendicular to one another and members parallel to one another. Further, a preferred embodiment of the apparatus of the present invention is adaptable to a range of Rebar or wire mesh from ⅜ inch to ⅝ inch diameters.

In one aspect, the present invention is an improvement in wire clips of the art as an embodiment provides a single length of at least partially hardened metal wire with a central off-set circular spring member. A pair of un-equal length ends extend crossing from the spring member. These ends can bend according to specification to provide securing connection for at least two reinforcing bars. The present invention secures bars spatially aligned horizontally, one to the other, perpendicularly, one to the other, or in any angular relation, one to the other.

In another aspect, the present invention is an improvement over wire clips of the art as an embodiment provides a clip comprising a single length of high grade polyvinyl-chloride, high grade poly-carbon, or high grade composite materials comprising carbon fibers, such as graphite wire.

It is therefore desirable to provide an improved apparatus for securing reinforcing bars or mesh grids in position in molds for concrete so as to prevent displacement of the bars or grids while the concrete is being poured or otherwise manipulated prior to setting or hardening of the concrete.

It is an object of the present invention to provide an improved apparatus and a method of using the same without the necessity of auxiliary tools to secure the fasteners into the desired placement on the mesh or Rebar to join like or unlike sized members.

It is a further objective of the present invention to provide an apparatus and methods to join the mesh or Rebar members in any angular relation, one to the other, and which are particularly useful for such members perpendicular to one another and members parallel to one another.

It is still a further objective of the present invention to provide an apparatus of single size and uniform assembly adaptable to a range of Rebar or wire mesh from ⅜ inch to ⅝ inch diameters.

It is yet a further objective of the present invention to provide an improved apparatus for securing reinforcing bars or mesh grids in position in molds for concrete, and a method of using the same, which is quick and can be accomplished by hand with a minimal amount of training or supervision.

Yet another object of the present invention is to provide an improved apparatus for securing reinforcing bars or mesh grids in position in molds for concrete that is easily carried in bulk by workmen installing the same.

It is therefore another object of the present invention to provide a new and improved apparatus for securing reinforcing bars which can be manufactured and used to connect any size or type of semi-rigid rod or tube, or square channel in commercial construction environments including, but not limited to, Rebar, wire mesh sheets of Rebar positioned in a grid pattern, drop ceiling support wire connecting to flexible electrical wire cable, and the like, as well medical, aviation, and space-craft applications.

It is still another object of the present invention to provide a new and improved Rebar connector apparatus which may be easily and efficiently manufactured and marketed.

It is a further object of the present invention to provide new and improved Rebar connector apparatus which is of durable and reliable constructions.

An even further object of the present invention to provide a new and improved Rebar connection apparatus which is susceptible of low cost of manufacture with regard to both materials and labor, and which accordingly in then susceptible of low prices of sale to the consuming public, thereby making such apparatus economically available to the buying public.

It is still further an object of the present invention to provide apparatus for more convenient connection of Rebar or similar concrete reinforcement materials.

Lastly, it is an object of the present invention to provide a new and improved Rebar clip connector including a pre-sized, member to fit standard Rebar with different sized diameters from ⅜ inch to ⅝ inch in perpendicular, horizontal, or any angular alignment.

These together with other objects of the invention along with the various features of novelty which characterize the invention are pointed out with particularity in the claims annexed to and forming a part of this disclosure. For a more complete understanding of the invention, its operating advantages and the specific objects attained by its uses, reference should be had to the accompanying drawings and descriptive matter in which there is illustrated preferred embodiments of the invention.

All other features, advantages, and objects of the present invention will become apparent with reference to the following description and accompanying drawings.

DETAILED DESCRIPTION OF THE INVENTION

Figure 1:
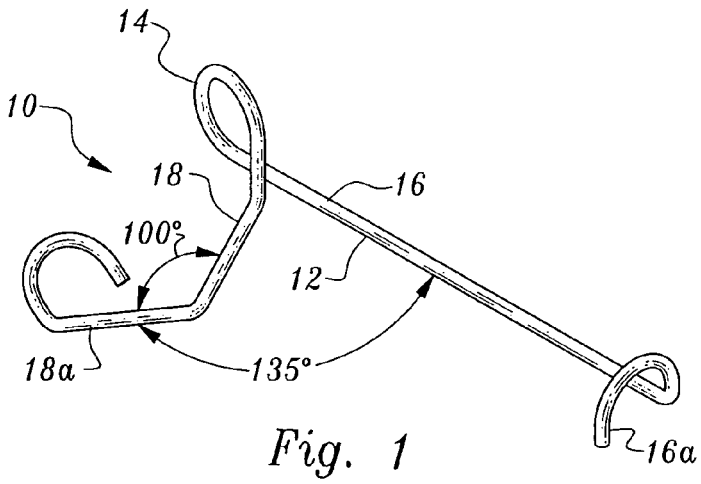
FIG. 1 is a perspective view of an embodiment of the present invention.
Figure 2:
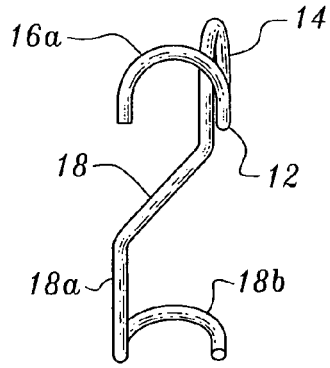
FIG. 2 is an end elevation view of an embodiment of the present invention.
Figure 3:
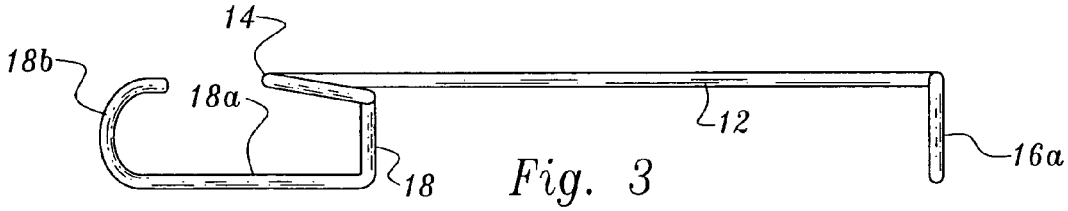
FIG. 3 is a top plan view of an embodiment of the present invention.

Particular terminology used in this disclosure is for convenience only and is not intended to be limiting. The words "right", "left", "lower", and "upper" designate directions in the drawings to which reference is made. The words "radial" and "axial" refer to directions perpendicular to and along the central axis of, respectively, an object, element or structure referred to. The words "inwardly" and "outwardly" refer to directions towards and away from, respectively, the geometric center of the object, element or structure. The words "internal angle" and "external angle" refer to angles defined by portions of the object, element or structure with directions towards and away from, respectively, the geometric center of the object, element or structure. The word "transverse" means crosswise or at right angles to the longitudinal axis of the object, element or structure. The terminology includes the words above specifically mentioned, derivatives thereof and words of similar import. Throughout the drawings, moreover, like numerals are used to indicate like elements.

Figure 5:
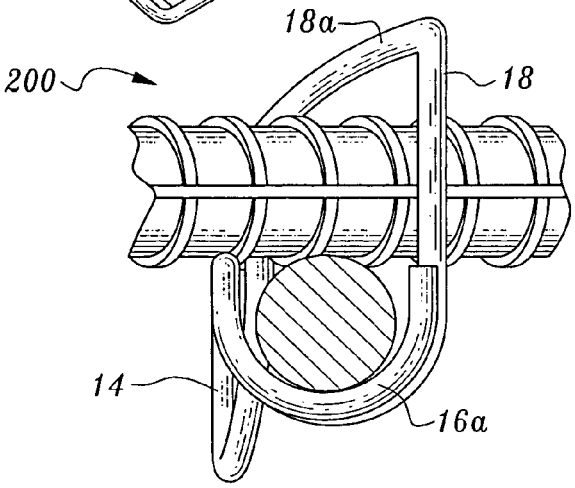
FIG. 5 is an end elevation view of an embodiment of the present invention applied at the junction of two perpendicularly crossed reinforcement rods or bars.
Figure 6:
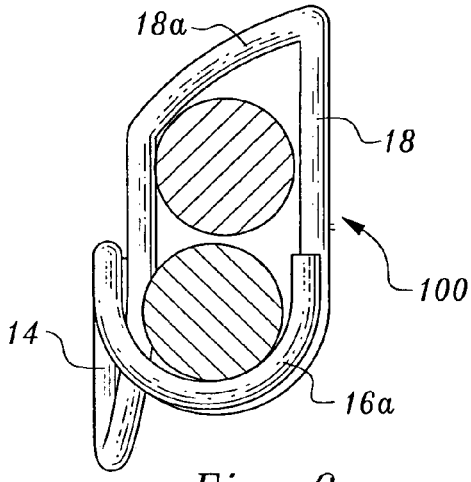
FIG. 6 is an end elevation view of an embodiment of the present invention applied at the junction of two reinforcement rods or bars aligned in parallel.
Figures 7, 8, 9, 10:
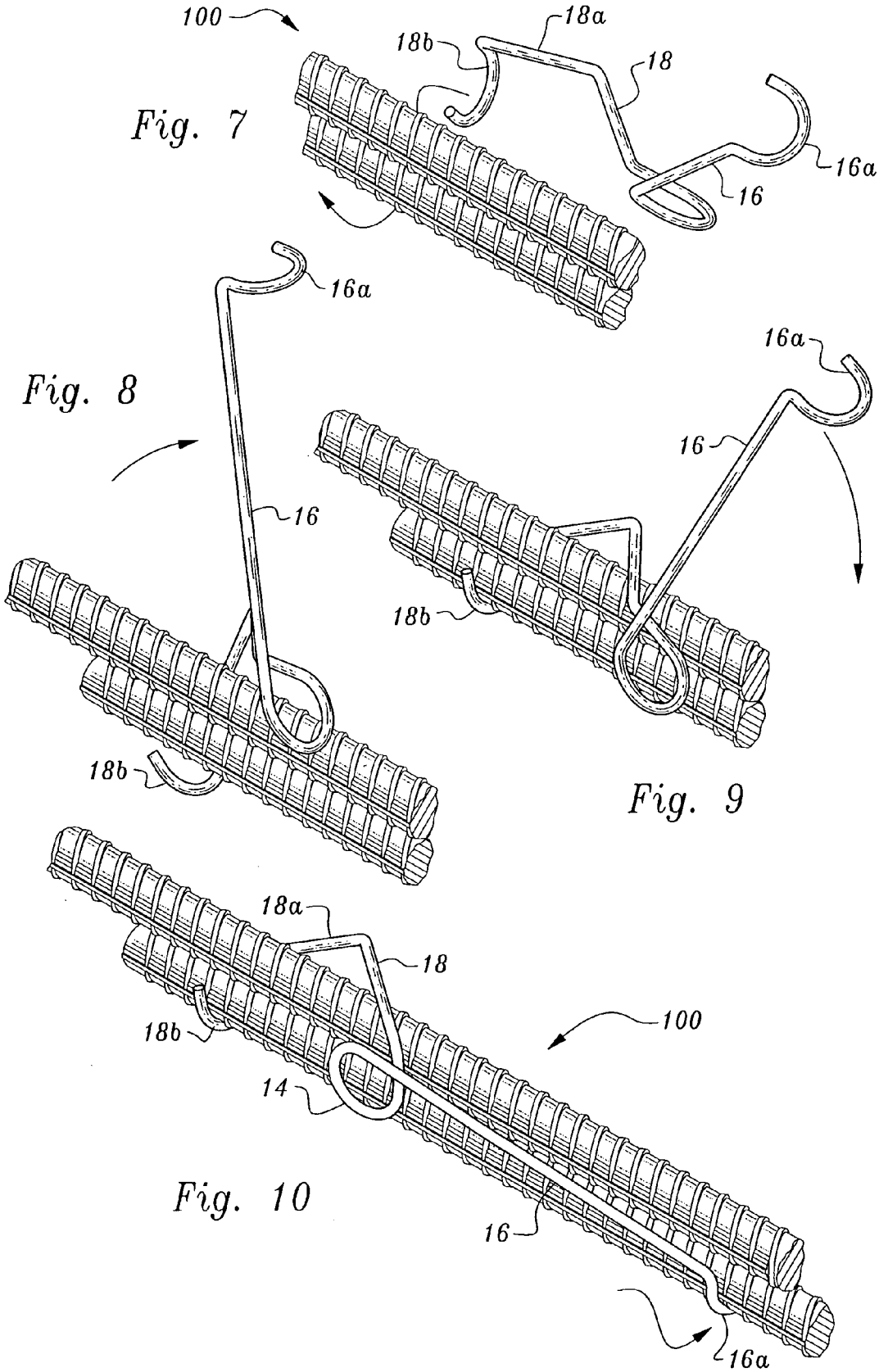
FIG. 7 is a perspective view of an embodiment of the present invention showing attachment of one loop end to the junction of two reinforcement rods or bars aligned in parallel.
FIG. 8 is a perspective view of an embodiment of the present invention showing movement through the resilient spring element of the leg opposing the attached loop end towards the junction of two rods reinforcement or bars aligned in parallel.
FIG. 9 is a perspective view of an embodiment of the present invention showing further movement of the leg opposing the attached loop end towards the junction of two reinforcement rods or bars aligned in parallel, further opening the resilient spring element.
FIG. 10 is a perspective view of an embodiment of the present invention showing attachment of the loop of the second leg wherein the opposing the attached loop ends and resilient spring member serve to hold the reinforcement rods or bars in parallel alignment.
Figure 11:
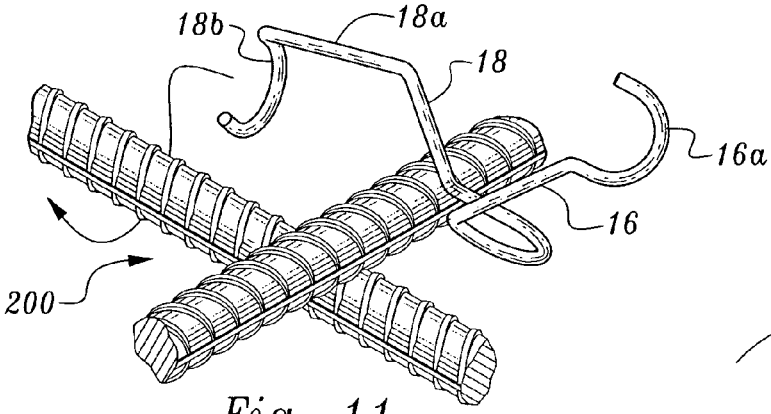
FIG. 11 is a perspective view of an embodiment of the present invention showing attachment of one loop end to the junction of two reinforcement rods or bars perpendicularly aligned.
Figure 12:
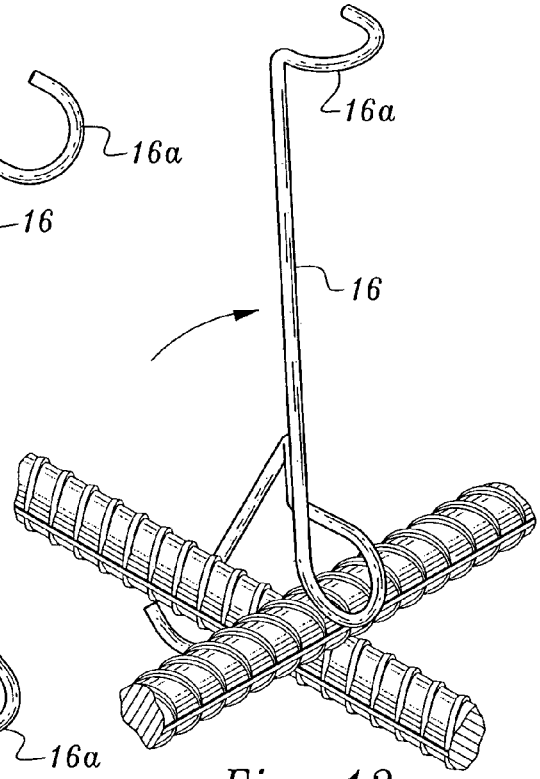
FIG. 12 is a perspective view of an embodiment of the present invention showing movement through the resilient spring element of the leg opposing the attached loop end towards the junction of two reinforcement rods or bars perpendicularly aligned.
Figure 13:
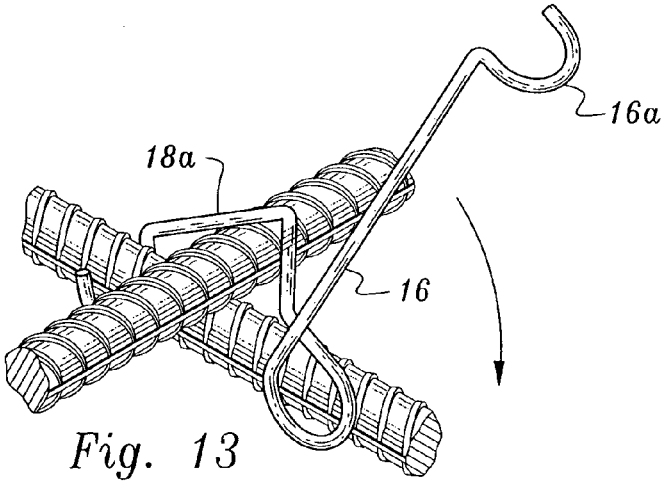
FIG. 13 is a perspective view of an embodiment of the present invention showing further movement of the leg opposing the attached loop end towards the junction of two reinforcement rods or bars perpendicularly aligned, further opening the resilient spring element.
Figure 14:
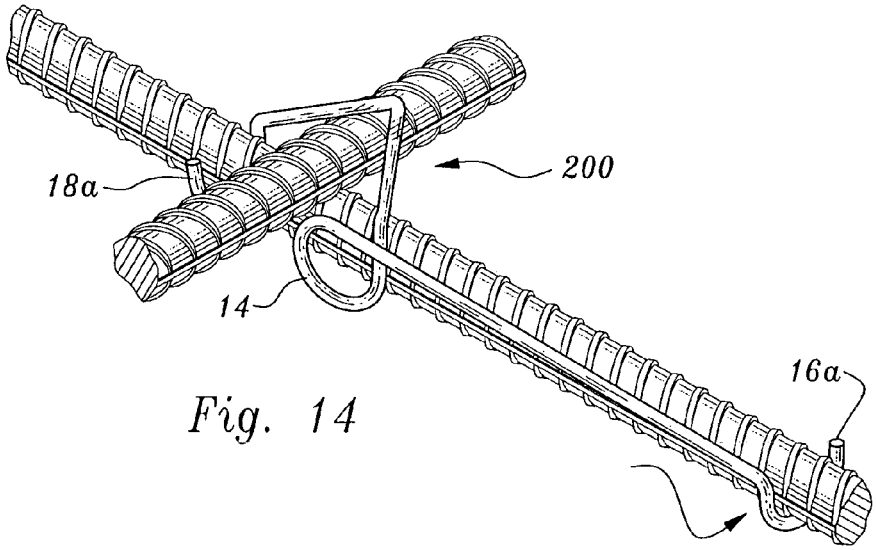
FIG. 14 is a perspective view of an embodiment of the present invention showing attachment of the loop of the second leg wherein the opposing the attached loop ends and resilient spring member serve to hold the reinforcement rods or bars in perpendicular alignment.

As depicted generally in FIGS. 1-14, the present invention provides an improved apparatus and method of use of the apparatus for securing reinforcing bars steel rods, Rebar, or mesh grids in position in molds. The preferred embodiment of the present invention is particularly suited for concrete molds to prevent displacement of reinforcement bars, 100 (parallel/horizontal) and 200 (perpendicular) of FIGS. 5-14, or grids while the concrete is being poured or otherwise manipulated prior to setting or hardening of the concrete. The present invention further provides apparatus and a method of using the same without the necessity of auxiliary tools to secure the fasteners into the desired placement on the mesh or Rebar to join like or unlike members. The apparatus and methods of the present invention can join the mesh or Rebar members in any angular relation, one to the other, and is particularly useful for members perpendicular 200 to one another and members parallel 100 to one another, FIGS. 5-6. Further, a preferred embodiment of the apparatus of the present invention is adaptable to a range of Rebar or wire mesh from ⅜ inch to ⅝ inch diameters in any combination. The present invention can be specifically sized for one diameter of Rebar for specialized applications such as bridges, dams, and the like, where Rebar or mesh element diameters might be as large as 1-2 inches, or larger. Similarly, the present invention is equally suitable for very small sized diameters where micro- or nano-technological applications, such as surgery or skin grafting, are required.

In one aspect, FIG. 1-4, the present invention is an improvement in wire clips of the art as an embodiment provides a single length of at least partially hardened metal wire, such as 2 millimeter spring wire, or the like, with a central off-set circular spring means/member 14 having a pair of un-equal length end-, arm- or leg-members, 16 and 18, with loops, 16*b* and 18*a*, respectively, on each end. These end-, arm- or leg-members, 16 and 18, cross from the spring member 14 and can moveably bend therefrom according to specification to provide securing connection for at least two reinforcing bars spatially aligned horizontally 100, one to the other as depicted in FIGS. 6-10, perpendicularly 200, one to the other as depicted in FIGS. 5, 11-14, or in any other alignment defining an acute interior angle between the bars (not shown).

The loops, 16*a* and 18*b*, serve to secure the bars to be connected. As such, it is a critical feature of the present invention that the loops, 16*a* and 18*b*, be sized and angularly oriented to allow the operator to quickly and easily secure the loop ends to the bars. One loop, 18*b*, is at an obtuse angle to its attached end-, arm- or leg-member, 18*a*. This orientation to the end-, arm- or leg-member, 18*a*, allows the loop, 18*b*, to first engage the bottom of the spatially aligned bars, FIGS. 7-9 or 11-13, and serve as the clip's fulcrum for the clip to turn about the spring means 14 and engage the second bar, holding the second bar in the desired position. Upon securing the other loop, 16*a*, under the bottom bar, FIGS. 10 and 14, the clip's resilient spring means exerts upward forces to the bottom bar at the loops, 16*a* and 18*b*, downward forces on the upper bar at one of the end-, arm- or leg-members, 18 and 18*a*, and alignment forces from both end-, arm- or leg-members, 18/18*a* and 16, to the bars, FIGS. 5-14. The loops, 16*a* and 18*b*, may be semicircular or between a quarter-circle and semicircle (not shown) depending upon the application.

In another aspect, the present invention is an improvement over wire clips of the art as an embodiment provides a single length of high grade polyvinylchloride, high grade poly-carbon, or high grade composite materials comprising carbon fibers, such as graphite wire, molded with a central off-set circular spring member 14 with a pair of un-equal length end-, arm- or leg-members, 16 and 18, crossing from the spring member 14 and bending therefrom according to specification to provide securing connection for at least two reinforcing bars spatially aligned either horizontally 100, one to the other, or perpendicularly 200, one to the other.

Figure 4:
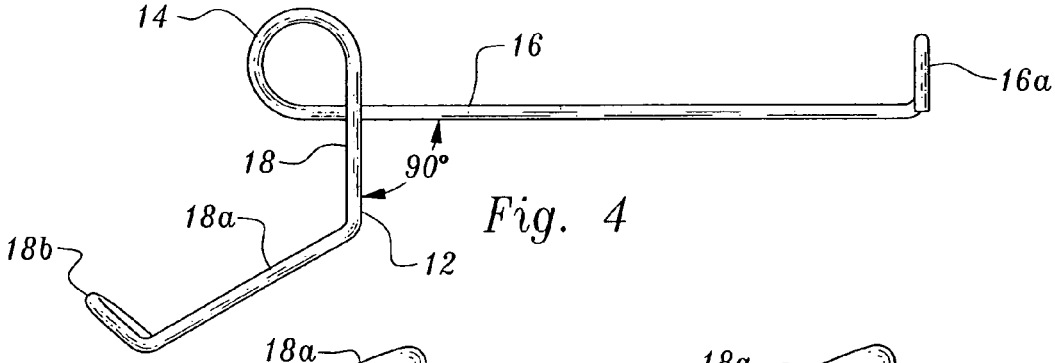
FIG. 4 is a side elevation view of an embodiment of the present invention.

FIGS. 1-4, depict an embodiment of the present invention indicated generally at 10. The clip connector 10 is made from a single length of at least partially hardened wire 12. The wire 12 is bent near its center to define an resilient spring, off-set loop 14 of predetermined radius having two, off-set rod end-, arm- or leg-members, 16 and 18, of unequal length and uniform cross-section extending therefrom which define interior and exterior angles in relation to their direction from the off-set loop resilient spring 14. As depicted in FIG. 4, the rod end-, arm- or leg-members, 16 and 18, define an exterior angle of 90 degrees in an x-z axis planar orientation. The longer resilient spring means rod end-, arm- or leg-member length 16 is straight and comprises a transverse semicircular loop of predetermined radius 16*a* at its end. The shorter resilient spring means rod end-, arm- or leg-member length 18 is angled and comprises a second angled portion 18*a* at a predetermined angle to the shorter rod end-, arm- or leg-member length 18 and further comprises a semicircular loop of predetermined radius 18*b* at a predetermined obtuse angle at the end of the angled portion 18*a*. The longer resilient spring means rod end-, arm- or leg-member length 16 defines an angle of 135 degrees to the second angled portion 18*a* of the shorter rod angled end-, arm- or leg-member length 18 in an x-y axis planar orientation. The angled portion 18*a* of the shorter rod angled end-, arm- or leg-member length 18 is at a 100 degree angle to the shorter rod angled end-, arm- or leg-member length 18 in an y-z axis planar orientation.

The resilient spring, off-set loop 14 is critical to the operation of the speed clip connector 10 in securing at least two reinforcing bars spatially aligned horizontally, one to the other, or perpendicularly, one to the other, or any two reinforcing bars in any angular relation, one to the other. As shown in FIGS. 7-10, the loop 14 allows the semicircular loop, 18*b*, to engage the bottom member of either horizontally aligned Rebar members, 100, or, as shown in FIGS. 11-14, perpendicularly aligned Rebar members, 200. The user then rotates the speed clip connector 10 from the engaged loop, 18*b*, portion through the off-set loop 14 so that the transverse semicircular loop, 16*a*, travels below the assembly and engages and locks onto the bottom member at a position apart from the semicircular loop, 18*b*, FIGS. 6-10 and 12-14. The resilient spring, off-set loop 14 secures the top Rebar member in place while providing the necessary opposing spring forces to lock the loops 16*a* and 18*b* into position upon the bottom Rebar member, FIGS. 5, 6, 10, and 14.

In an embodiment of the present invention, depicted generally in FIGS. 1-4, the resilient spring, off-set loop 14 defines a radius of 0.85 centimeters. The transverse semicircular loop 16*a* defines a radius of 0.85 centimeters. The semicircular loop 18*b* defines a radius of 0.85 centimeters. A 10 centimeter dimension includes the length of the longer resilient spring means rod end-, arm- or leg-member length 16 from the transverse loop 16*a* through an exterior tangent line of the resilient spring, off-set loop 14 which is parallel to the transverse loop 16*a*. The shorter rod angled end-, arm- or leg-member length 18 is 1.7 centimeters in length. The second angled portion 18*a* is 3.5 centimeters in length. The dimension between the semicircular loop 18*b* and an interior tangent line of the resilient spring, off-set loop 14 parallel to the loop 18*b* is 4.0 centimeters.

With respect to the above description then, it is to be understood and realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

A latitude of modification, change and substitution is intended in the foregoing disclosure, and in some instances some features of the invention will be employed without a corresponding use of other features. Therefore, it is appropriate that the appended claims be considered broadly and in a manner consistent with the spirit and scope of the invention disclosed herein.

It should be appreciated that this invention is not limited to the particular embodiments or instrumentalities shown, but is intended to cover all modifications which are within the scope and spirit of the invention as defined by the appended claims.

We claim:

1. A clip connector, comprising:

resilient spring means having two, off-set legs of unequal length and uniform cross-section, each off-set leg having an end and extending from the spring means to define interior and exterior angles in relation to its direction from the spring means;

wherein the longer leg is straight and comprises a transverse loop of predetermined radius at its end;

wherein the shorter leg comprises a first angled portion, a second angled portion, and a loop of predetermined radius at the end of the second angled portion at a predetermined obtuse angle, wherein each angled portion defines a predetermined angle one to the other and to the longer leg;

whereby the longer leg is at a 135 degree exterior angle to the second angled portion of the shorter leg in an x-y axis planar orientation; and whereby the first angled portion of the shorter leg is at a 100 degree angle to the second angled portion of the shorter leg in an y-z axis planar orientation.

2. The apparatus of claim 1, wherein resilient spring means comprises an off-set loop of predetermined radius and the longer leg defines an exterior angle of 90 degrees to the first angled portion of the shorter leg in an x-z axis planar orientation.

3. The apparatus of claim 2, wherein the radius of the off-set loop is 0.85 centimeters.

4. The apparatus of claim 2, wherein the off-set loop, semicircular loops, and legs comprise material selected from the group consisting of metal, high grade polyvinylchloride, high grade poly-carbon, and high grade composite materials comprising carbon fibers.

5. The apparatus of claim 1, wherein the radius of each loop is 0.85 centimeters.

6. The apparatus of claim 1, wherein each loop can receive material of uniform diameters ranging from ⅜ inch to ⅝ inch.

7. The apparatus of claim 1, wherein the loop at the end of the second angled portion of the shorter leg is a semicircle.

8. The apparatus of claim 1, wherein the transverse loop at the end of the longer leg is a semicircle.

9. The apparatus of claim 1, wherein the transverse loop at the end of the longer leg is greater than a quarter-circle but less than a semicircle.

10. A clip connector for securing bars for concrete reinforcement, comprising a predetermined length of 2 millimeter spring wire, the length of wire sufficient to further comprise:

an off-set loop having a radius of 0.85 centimeters defining various internal and external tangents thereto and two extending lengths;

a first extending length from the off-set loop comprising a straight length having an end comprising a transverse loop having a radius of 0.85 centimeters wherein the overall length from the transverse loop to an external tangent of the off-set loop parallel to the transverse loop is 10 centimeters;

a second extending length from the off-set loop comprising a first angled portion 1.7 centimeters in length and perpendicular to the first extending length in an x-z axis planar orientation, a second angled portion 3.5 centimeters in length having an end, and a loop having a radius of 0.85 centimeters at the end of the second angled portion at a predetermined obtuse angle to the second angled portion, wherein the first angled portion and the second angled portion define a 100° angle one to the other in an y-x axis planar orientation, the second angled portion defines a 135° angle to the first extending length in an x-y axis planar orientation, and wherein the overall length from the loop at the end of the second angled portion to an inside tangent of the off-set loop parallel to the obtuse angled loop is 4.0 centimeters.

11. The apparatus of claim 10, wherein the obtuse angled loop at the end of the second angled portion is a semicircle.

12. The apparatus of claim 10, wherein the transverse loop at the end of the first extending length is a semicircle.

13. The apparatus of claim 10, wherein the transverse loop at the end of the first extending length is greater than a quarter-circle but less than a semicircle.

14. A method of connecting concrete reinforcement steel, the method comprising the steps of:

providing a clip apparatus according to claim 1;

providing at least two reinforcement rods;

positioning the two rods in a predetermined alignment wherein one member is below and contacting the second member;

securing the apparatus loop at the end of the shorter leg around the bottom rod;

extending the apparatus longer leg such that the attached loop provides a fulcrum for the apparatus whereby the forces engaging the rods from the resilient spring means hold the rods in the desired alignment; and securing the apparatus loop at the end of the apparatus longer leg around the bottom rod such that the rods are secured in the desired alignment by the clip.

15. The method of claim 14 wherein the predetermined alignment is parallel.

16. The method of claim 14 wherein the predetermined alignment is perpendicular.

17. The method of claim 14, wherein the predetermined alignment defines an acute interior angle between the rods.

* * * * *